US006782711B2

(12) United States Patent
Abfalter

(10) Patent No.: US 6,782,711 B2
(45) Date of Patent: Aug. 31, 2004

(54) PORTABLE COOLER CHEST

(76) Inventor: James M. Abfalter, 3354 Lamp Post La., Traverse City, MI (US) 49684

( * ) Notice: Subject to any disclaimer, the term of this patent is extended or adjusted under 35 U.S.C. 154(b) by 0 days.

(21) Appl. No.: 10/312,127

(22) PCT Filed: Sep. 11, 2002

(86) PCT No.: PCT/US02/28860

§ 371 (c)(1),
(2), (4) Date: Sep. 23, 2003

(87) PCT Pub. No.: WO03/023296

PCT Pub. Date: Mar. 20, 2003

(65) Prior Publication Data

US 2004/0093892 A1 May 20, 2004

Related U.S. Application Data

(60) Provisional application No. 60/318,883, filed on Sep. 11, 2001.

(51) Int. Cl.[7] ..... F25D 3/08

(52) U.S. Cl. ..... 62/457.7; 62/459

(58) Field of Search ..... 62/421, 457.7, 62/459; 220/23.83, 23.86, 23.87, 501, 505, 507, 533, 822

(56) References Cited

U.S. PATENT DOCUMENTS

| | | | | | |
|---|---|---|---|---|---|
| 2,579,335 | A | * | 12/1951 | Pownall | 62/421 |
| 5,493,874 | A | * | 2/1996 | Landgrebe | 62/457.2 |
| 5,671,611 | A | * | 9/1997 | Quigley | 62/457.7 |
| 6,039,202 | A | * | 3/2000 | Olstad et al. | 220/533 |
| 6,349,559 | B1 | * | 2/2002 | Hasanovic | 62/457.7 |
| 6,357,252 | B1 | * | 3/2002 | Rand | 62/457.7 |

* cited by examiner

*Primary Examiner*—William E. Tapolcai
(74) *Attorney, Agent, or Firm*—Varnum, Riddering, Schmidt & Howlett LLP

(57) ABSTRACT

A cooler chest includes an outer unit and a separate inner unit having a height smaller than the height of the outer unit and a space over the inner unit for storing ice cubes, the space being defined in part by porous side walls that allow for drainage of water, resulting from the melting of ice cubes, from the ice cube storage area.

8 Claims, 5 Drawing Sheets

PORTABLE COOLER CHEST

This application claims the benefit of Provisional Application No. 60/318,883, filed Sep. 11, 2001.

BACKGROUND OF THE INVENTION

1. Field of the Invention

This invention relates to chests for storing products at a temperature different from the temperature of the surrounding atmosphere.

2. Background Art

Typically, prior art portable coolers, also referred to as ice chests, typically comprise a single chamber where ice, in the form of the ice cubes or the like, is placed in the chamber in direct contact with items to be cooled. A disadvantage of such portable coolers is that food items that are not tightly sealed become wet as the ice melts, often spoiling the food items. Furthermore, a relatively large amount of ice is often required to cool a relatively few items since the ice tends to collect on the bottom of the ice chest, not adequately covering the items to be cooled. A further disadvantage of prior art coolers where in ice is stored in a lower area of the container is that as some melting occurs, lower layers of ice cubes in contact with the water tend to melt quicker, thereby reducing the cooling effect of ice cubes not in contact with water.

These problems have been recognized in the prior art and various configurations of ice chests have been used for separating food from melting ice. However, cooling units designed to solve this problem generally have been constructed in an elaborate manner and are often clumsy to transport and too expensive for casual users, for example, for family picnics and the like.

SUMMARY OF THE INVENTION

These problems and disadvantages of the prior art are overcome in accordance with the present invention by providing a portable cooler with a separate, water tight food storage compartment that is easily accessible and an ice storage area immediately above the food storage area where ice is retained separate from food items.

Advantageously, in accordance with the present invention ice is retained in an area where it is more effective for cooling of the products within the food storage area.

In accordance with another aspect of the invention, spacial areas are provided adjacent opposing sides of the food storage container and water resulting from the melting of ice within the ice storage area is drained to an area removed from the ice cubes.

Advantageously, less ice is required to cool the upper portion of the food storage compartment, since the ice is retained in an optimum cooling location.

BRIEF DESCRIPTION OF THE DRAWINGS

The invention will now be described with reference to the drawings wherein.

DESCRIPTION OF THE PREFERRED EMBODIMENTS

Figure 1:
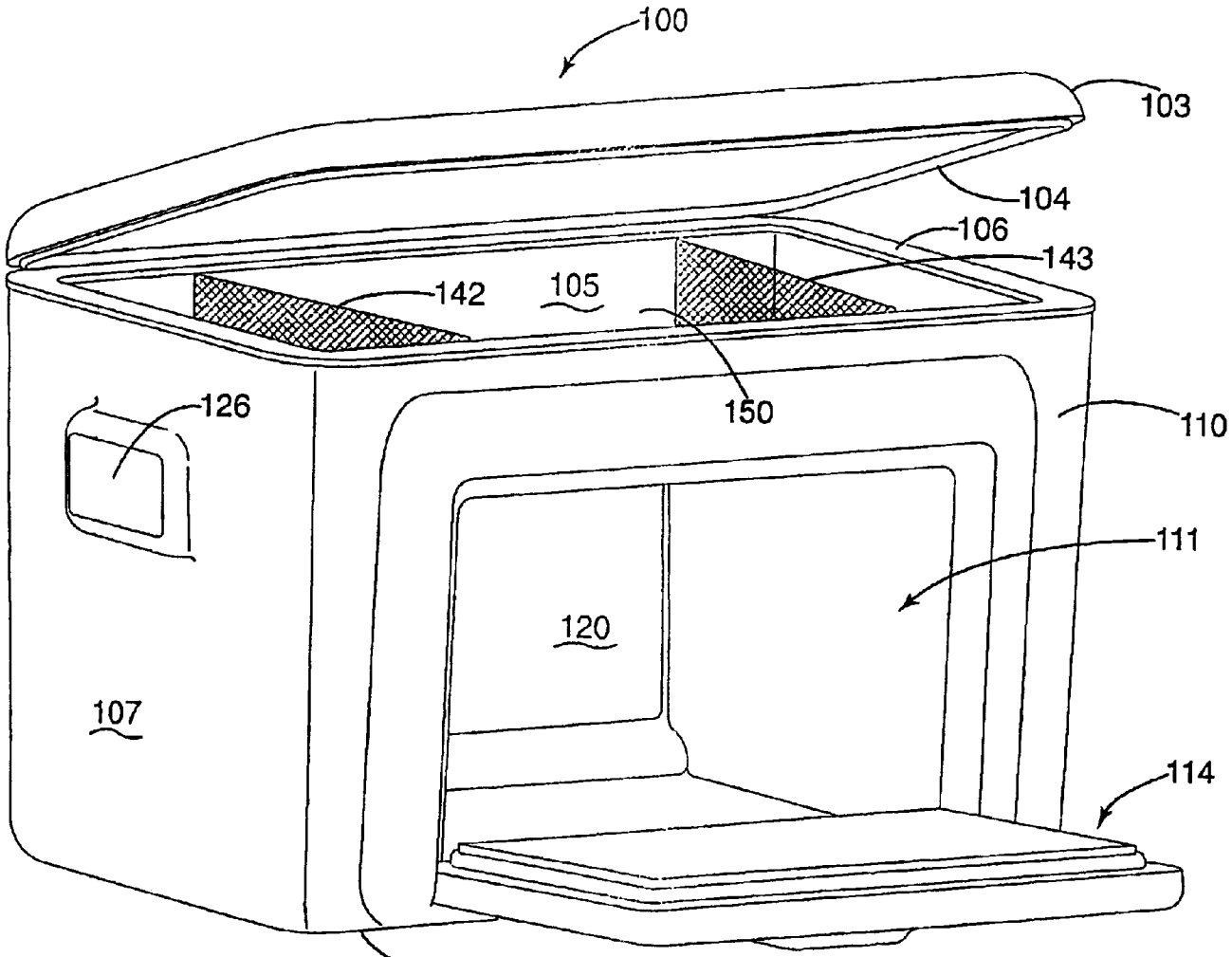
FIG. 1 is a perspective view of a cooler incorporating aspects of the invention.

Referring now to FIG. 1 there shown a perspective view of a cooler 100 comprising a frontal wall 110 having an opening 111 and a door unit 114 for covering the opening 111. The door 114 is hingedly attached to a lower edge of the opening 111. The cooler 100 is further provided with a hinged cover 103, hingedly attached to a rear wall 105 of the cooler. Opposing side walls 106, 107 extend between the frontal wall 110 and the rear wall 105. The frontal wall 110, rear wall 105 and side walls 106, 107 are attached to a bottom wall 108. An inner spacial area 150 is defined by the walls 105, 106, 107 and 110, and a food storage housing 120 extends through an opening 111 inn the frontal wall 110 and into the inner spacial area 150. A door 114 is provided to seal the frontal opening of the housing 120. Further shown in FIG. 1, are upstanding side walls 142, 143. The side walls 142, 143 extend between the front and rear walls 110, 105 of the cooler 100 and extend upwardly from a top wall 145 of the food container 120. The side walls 142,143 serve to retain ice cubes, or the like, within a spacial area defined by the side walls 142, 143, the rear wall 105, front wall 110.

Figure 2:
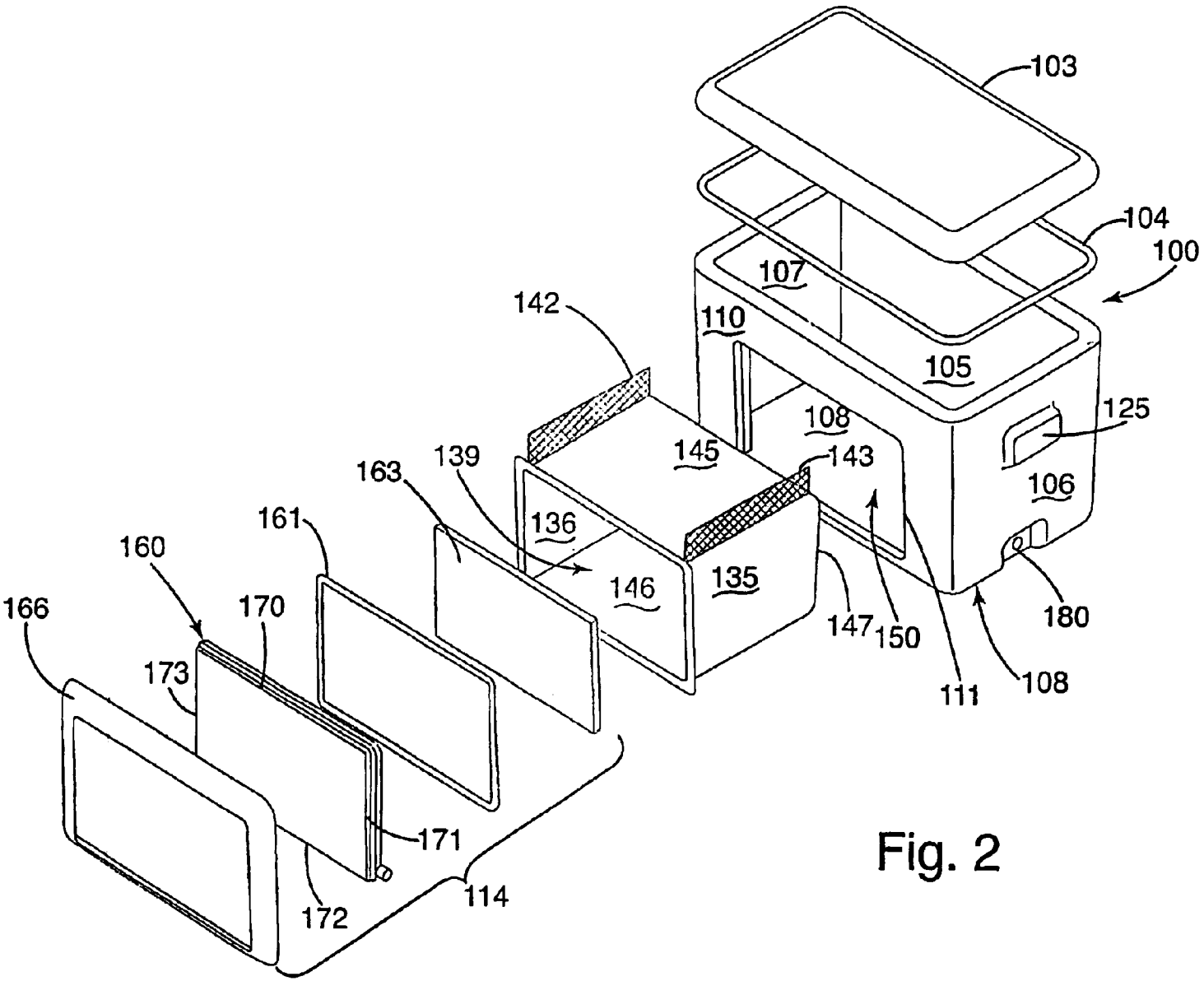
FIG. 2 is an exploded perspective view of the cooler of FIG. 1.

Referring now to FIGS. 1 and 2, there is shown in FIG. 2 a left side perspective, exploded view of the cooler 100. FIG. 2 shows the structure of the food container housing 120. The housing 120 includes an inner food storage area 139, defined by opposing side walls 135 and 136, a top wall 145, a lower wall 146 and a rear wall 147. As depicted in FIG. 2, upstanding side walls 142 and 143 are mounted along upper edges of opposite sides 135, 136 of the housing 120. When the cooler 100 is in use, ice is preferably placed on the top wall 145 of the housing 120 and is retained within the spacial area defined by front and rear walls 110, 105, the side walls 142, 143 and the top surface of the top wall 145 of the food container housing 122. The sidewalls 142, 143 are provided to retain the ice within an area immediately over the inner spacial area 139 where food items to be cooled are preferably stored. The side walls 142, 143 are preferably of netting or screens, or the like to allow water resulting from the melting of ice disposed between the netting 142, 143 will drain along side walls 135, 136 of the food container housing 120, thereby separating the water from the ice. The water may then be drained from the cooler 100 by means of the drain 130.

Figure 3:
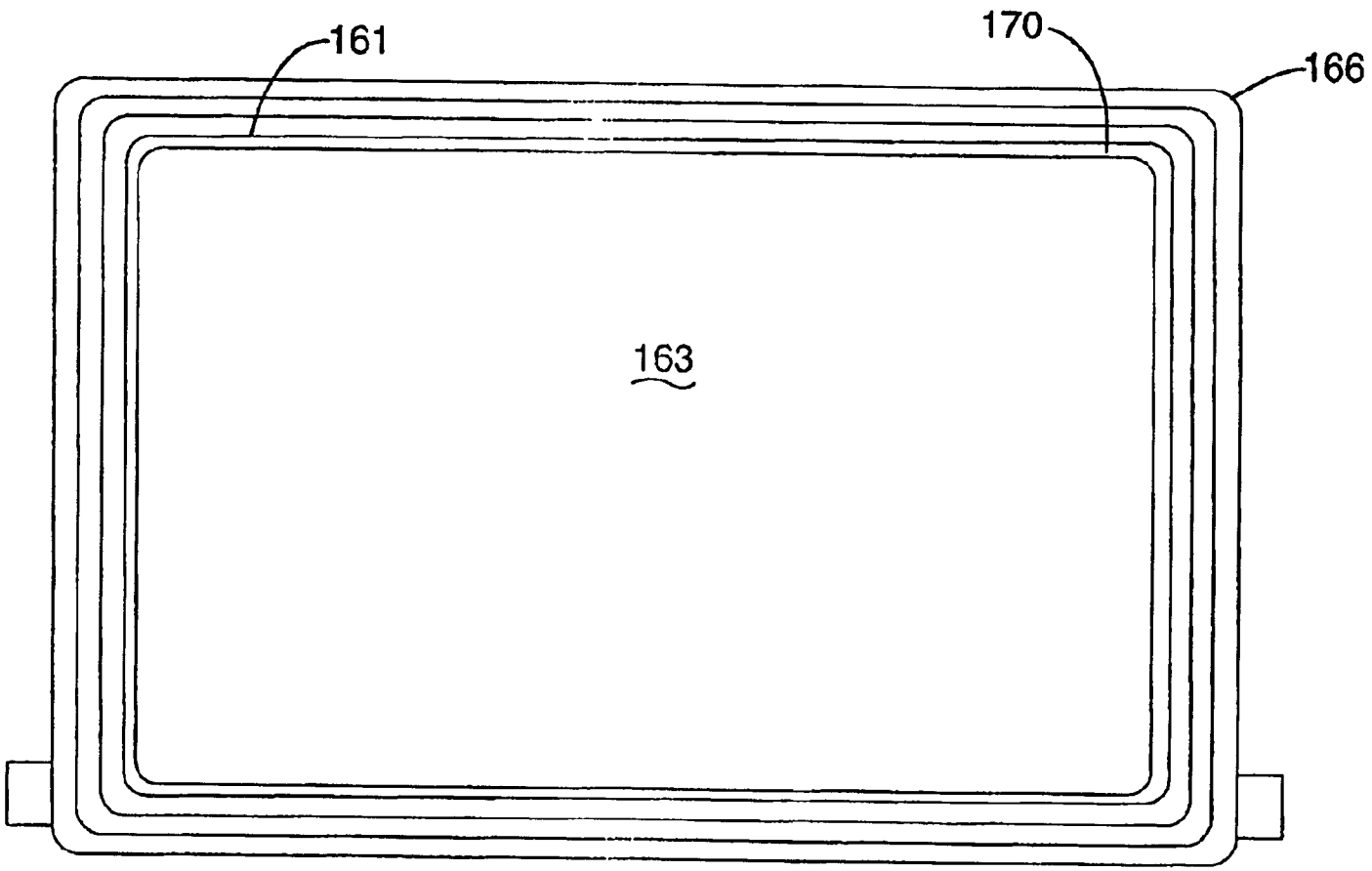
FIG. 3 is a plan view of the inner side of the door of FIG. 1.

The door unit 114 shown in FIGS. 1 and 2 comprises several items, as shown in the exploded view of FIG. 2. The door unit 114 comprises a door 160, which may be hingedly attached to the frontal side 110 of the cooler 100 in a standard fashion. A door seal 161 is preferable attached to the door 160 for form a seal with the periphery of the opening 111. The door 160 is preferably provided with an inner cavity 170 as depicted in FIG. 3. A cutting board 163 may be readily stored in the cavity 170, to be used when the door 160 is opened.

Further shown in FIG. 2 is a facia 166 preferably mounted around the circumferential edges 170 through 173 of the door 160, primarily for decorative purposes.

Figure 4:
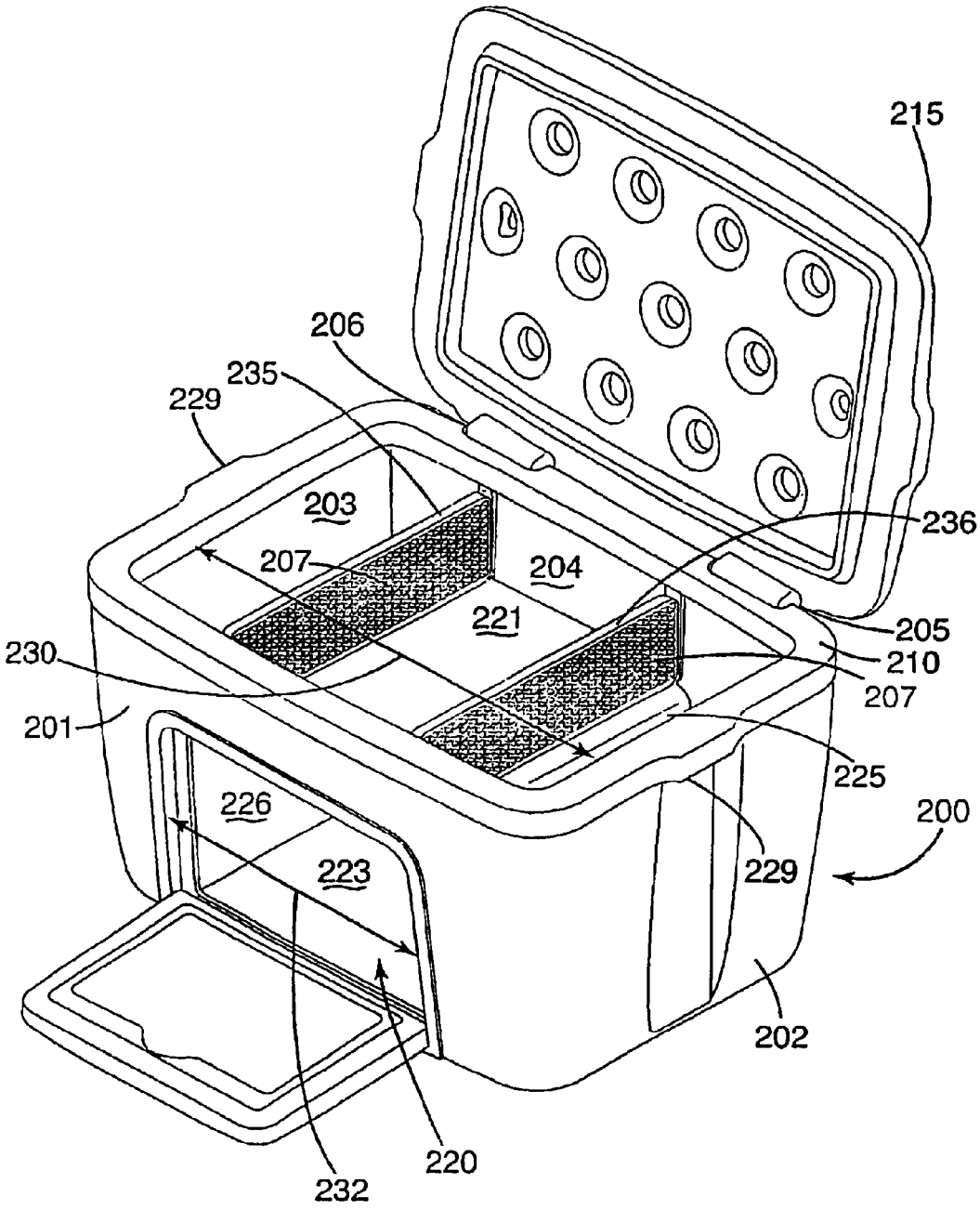
FIG. 4 is an alternate embodiment of a cooler incorporating principles of the invention.

FIG. 3 shows an alternate embodiment of a cooler chest 200 incorporating principles of the invention. The cooler chest 200, which may be formed by plastic molding, has a main body comprising a frontal wall 201, a left side wall 202, a right side wall 203 and a rear wall 204. A peripheral ledge 210 forms an upper surface for the walls 201–204. A cover 215 is hingedly attached to the rear wall 204 by hinges 205 and 206. Further shown in FIG. 4 is an inner food container unit 220 having an upper wall 221, a lower wall 223, side walls 225 and 226 and a rear wall (not shown in the drawing) adjacent the rear wall 204 of the cooler 200. Alternatively, the rear wall of the inner food container 220 may be formed by a portion of the rear wall of 204 of the cooler chest 200.

The cooler chest 200 has an interior width 230 and the food container 220 preferably has an overall width of 232 smaller than the interior width of 230 of the chest 200, to allow for spatial areas between opposing side walls 225 and 226 of the food container unit 200. Further shown in FIG. 4 are side walls 235 and 236 which, together with the upper wall 221 of the food container 220 and parts of the front and rear walls 201, 204, respectively, of the cooler 200 define a spatial storage area for storage and containment of ice cubes or the like. The side walls 235, 236 may be made of a plastic material, or the like, and provided with openings to allow for the escape of water resulting from the melting of ice cubes from the spatial storage area. The porous side walls 236, 237 serve to keep the ice cubes over the interior of the container unit 200, for optimum cooling effect, while allowing for the escape of water from melted ice cubes into the area between the exterior walls of the food container unit 220 and interior walls of the chest 200 and away from any food stored in the food container 200.

Figure 5:
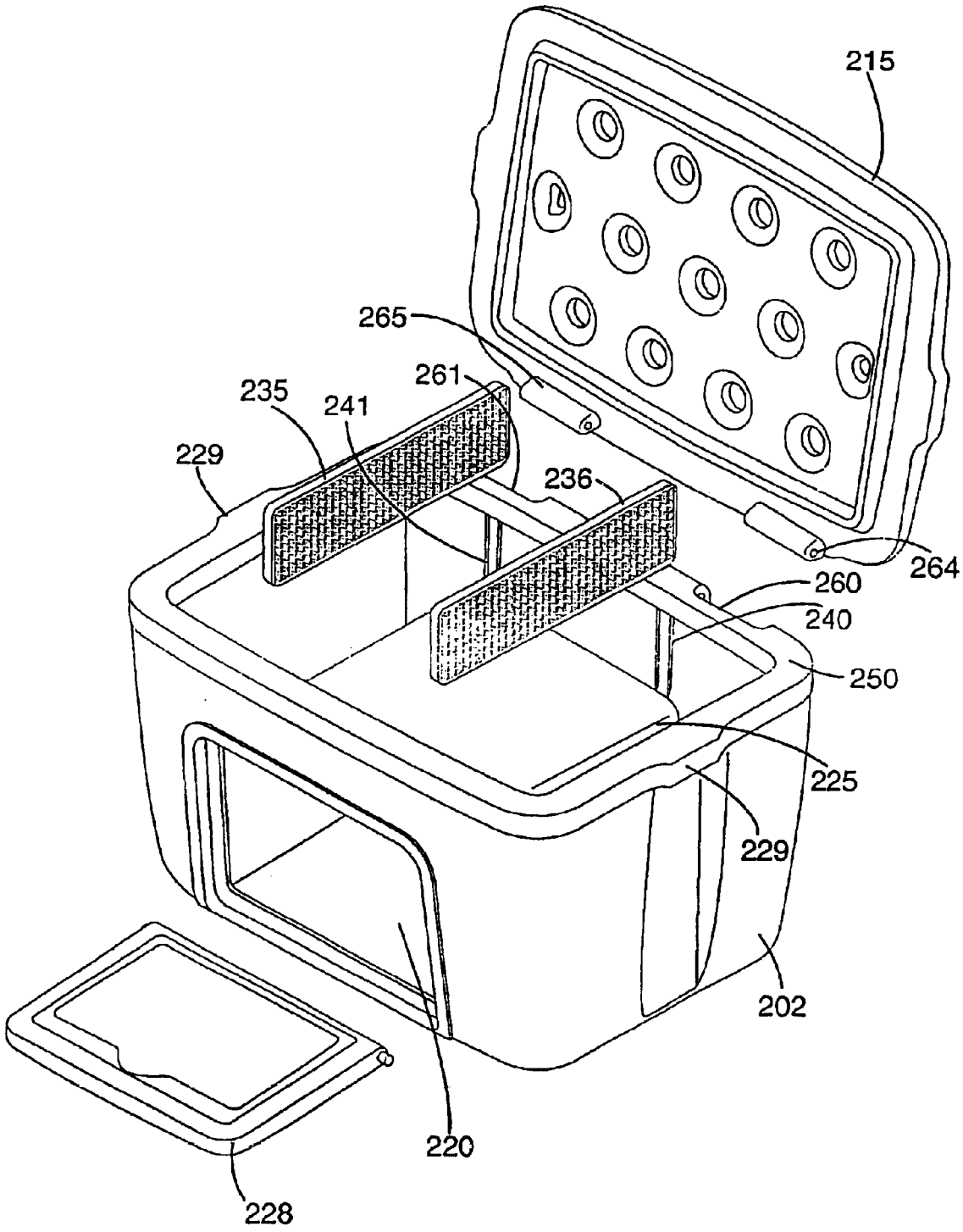
FIG. 5 is an exploded perspective view of the embodiment of FIG. 4.

FIG. 5 is a partially exploded view of the chest 200 of FIG. 4. The chest 200 may be formed by a molding process whereby the exterior surfaces of the chest, including the frontal wall 201, the side walls 202 and 203 and the rear wall 204 are formed from a molded exterior wall unit and a molded interior wall unit, with available space between the two wall units for insulation or the like, in a standard fashion. An upper rim 250 is preferably attached to the two wall units and provided with slotted openings 260 and 261 for receiving hinge portions 264 and 265 of the lid 215. The container unit 220 is provided with a door 228 hingedly attached to the chest 200 in a standard fashion, for closing off the container unit 200.

The upper rim 250 is preferably provided with side wall extensions 229 forming hand grips for conveniently carrying the cooler.

While particular embodiments of the invention ha%e been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

The embodiments of the invention in which an exclusive property or privilege is claimed are defined as follows:

1. A portable cooler chest comprising:

an outer cooler housing having a frontal wall and a rear wall and opposing side walls extending between said frontal wall and said rear wall;

said frontal and rear walls and said opposing side walls all having a predefined height;

an opening in said frontal wall;

an inner cooler housing disposed within said outer cooler housing and having a predefined height less than said predefined height of said outer cooler housing and a predefined width less than said predefined witdh of said outer cooler housing;

said inner cooler housing having an upper wall and opposing side walls and having a frontal opening disposed in alignment with said opening in said frontal wall of said outer cooler housing; and a spatial area between said opposing side walls of said outer cooler housing and said opposing side walls of said inner cooler housing;

said cooler chest further comprising opposing wall sections extending between said frontal wall and said rear wall of said outer cooling housing and disposed along said upper wall of said inner cooler housing, whereby ice may be retained in an ice storage area on said upper wall between said wall sections for cooling items disposed in said inner cooler housing.

2. The portable cooler chest in accordance with claim 1 wherein said wall sections are porous wall sections, thereby allowing for drainage of water resulting from melted ice cubes from said ice storage area.

3. The cooler chest in accordance with claim 2 and further comprising a frontal door for covering said opening in said frontal wall.

4. The cooler chest in accordance with claim 3 wherein said frontal door is hingedly attached adjacent said lower edge of said cooler chest, said door comprising an inner side disposed adjacent said inner cooler unit and a cavity in said inner side of said door for storage of a removable cutting board.

5. The cooler chest in accordance with claim 4 wherein said door comprises a fascia covering outer edges of said door.

6. The cooler chest in accordance with claim 1, wherein said outer cooler housing is formed from a molded outer wall unit having front and rear walls and opposing side walls having predefined dimensions and a molded inner wall unit having front and rear walls and opposing side walls and having dimensions smaller than said predefined dimensions, whereby an inner spatial area is formed between said walls of said inner wall unit and said walls of said outer wall unit.

7. The cooler chest in accordance with claim 6 and further comprising an upper rim extending over upper edges of said outer cooler and upper edges of said inner cooler housing.

8. The cooler chest in accordance with claim 7 and wherein said outer and said inner wall unit having upper edges and said cooler chest further comprises a lid and hinged portions on said lid, and wherein said upper rim comprises slotted openings for receiving said hinge portions of said lid.

* * * * *